US011498354B2

(12) United States Patent
Sambhy et al.

(10) Patent No.: US 11,498,354 B2
(45) Date of Patent: Nov. 15, 2022

(54) MULTI-LAYER IMAGING BLANKET

(71) Applicant: XEROX CORPORATION, Norwalk, CT (US)

(72) Inventors: Varun Sambhy, Pittsford, NY (US); Peter J. Knausdorf, Henrietta, NY (US); Ngoc-Tram Le, Potsdam, NY (US); Santokh S. Badesha, Pittsford, NY (US); Jack T. LeStrange, Macedon, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 17/003,231

(22) Filed: Aug. 26, 2020

(65) Prior Publication Data

US 2022/0063317 A1 Mar. 3, 2022

(51) Int. Cl.
*B41N 10/04* (2006.01)
*B41F 7/24* (2006.01)

(52) U.S. Cl.
CPC ..... *B41N 10/04* (2013.01); *B41F 7/24* (2013.01)

(58) Field of Classification Search
None
See application file for complete search history.

(56) References Cited

U.S. PATENT DOCUMENTS 4,339,553 A 7/1982 Yoshimura et al.
4,970,098 A 11/1990 Ayala-Esquilin et al.
4,997,642 A 3/1991 Curtis et al.
5,145,518 A 9/1992 Winnik et al.
5,146,087 A 9/1992 VanDusen
5,202,265 A 4/1993 LaMora
5,208,630 A 5/1993 Goodbrand et al.
5,225,900 A 7/1993 Wright
5,231,135 A 7/1993 Machell et al.
5,256,193 A 10/1993 Winnik et al.
5,271,764 A 12/1993 Winnik et al.
5,275,647 A 1/1994 Winnik et al.
5,286,286 A 2/1994 Winnik et al.
5,301,044 A 4/1994 Wright
5,356,485 A 10/1994 Kreider
5,378,574 A 1/1995 Winnik et al.
(Continued)

FOREIGN PATENT DOCUMENTS

DE 102018212949 A1 2/2020
EP 1900527 A1 3/2008
(Continued)

OTHER PUBLICATIONS

Author Unknown, "Chemical reactions on the 'finished' silicone," Silicones Europe, http://www.silicones.eu/science-research/chemistry/chemical-reactions-on-the-finished-silicone, accessed Dec. 13, 2014, pp. 1-4.

(Continued)

*Primary Examiner* — Joshua D Zimmerman
(74) *Attorney, Agent, or Firm* — MH2 Technology Law Group LLP

(57) ABSTRACT

A multilayer imaging blanket for a variable data lithography system, including a multilayer base including a sulfur-containing layer; and a cured topcoat layer including a polyurethane in contact with the sulfur-containing layer of the multilayer base.

19 Claims, 4 Drawing Sheets

(56) References Cited

U.S. PATENT DOCUMENTS 5,385,803 A 1/1995 Duff et al.
5,464,703 A 11/1995 Ferrar et al.
5,474,852 A 12/1995 Fitzgerald et al.
5,494,702 A 2/1996 Blaine et al.
5,539,038 A 7/1996 Katsen et al.
5,543,177 A 8/1996 Morrison et al.
5,547,759 A 8/1996 Chen et al.
5,554,480 A 9/1996 Patel et al.
5,593,807 A 1/1997 Sacripante et al.
5,621,022 A 4/1997 Jaeger et al.
5,629,416 A 5/1997 Neigel et al.
5,695,878 A 12/1997 Badesha et al.
5,700,568 A 12/1997 Badesha et al.
5,736,520 A 4/1998 Bey et al.
5,744,200 A 4/1998 Badesha et al.
5,750,204 A 5/1998 Badesha et al.
5,753,307 A 5/1998 Badesha et al.
5,808,645 A 9/1998 Reeves et al.
5,841,456 A 11/1998 Takei et al.
5,945,245 A 8/1999 Mychajlowskij et al.
6,020,300 A 2/2000 Tcheou et al.
6,042,227 A 3/2000 Meinhardt et al.
6,051,562 A 4/2000 Chamberlain et al.
6,103,815 A 8/2000 Mammino et al.
6,156,858 A 12/2000 Keoshkerian et al.
6,221,137 B1 4/2001 King et al.
6,348,509 B1 2/2002 Reeve
6,586,100 B1 7/2003 Pickering et al.
7,172,276 B2 2/2007 Breton et al.
7,202,883 B2 4/2007 Breton et al.
7,281,790 B2 10/2007 Mouri et al.
7,294,377 B2 11/2007 Gervasi et al.
7,374,812 B2 5/2008 Mizuno
7,547,137 B2 6/2009 Nakamura
7,582,359 B2 9/2009 Sabol et al.
7,608,325 B2 10/2009 Rasch et al.
7,767,011 B2 8/2010 Bedford et al.
7,780,286 B2 8/2010 Yahiro
7,828,480 B2 11/2010 Adelsberg et al.
8,038,284 B2 10/2011 Hori et al.
8,136,936 B2 3/2012 Hook et al.
8,142,557 B2 3/2012 Belelie et al.
8,215,762 B2 7/2012 Ageishi
8,247,066 B2 8/2012 Wu
8,268,399 B2 9/2012 Gervasi et al.
8,350,879 B2 1/2013 Larson et al.
8,500,269 B2 8/2013 Morita
8,919,252 B2 12/2014 Lestrange et al.
9,011,594 B1 4/2015 Kanungo et al.
9,022,546 B1 5/2015 Breton et al.
9,056,958 B2 6/2015 Kanungo et al.
9,126,430 B2 9/2015 Liu
9,138,985 B1 9/2015 Yang et al.
9,174,432 B2 11/2015 Liu et al.
9,187,587 B2 11/2015 Kanungo et al.
9,193,209 B2 11/2015 Dooley et al.
9,206,269 B2 12/2015 Kanungo et al.
9,211,697 B2 12/2015 Dooley et al.
9,227,393 B2 1/2016 Song et al.
9,233,533 B2 1/2016 Kanungo et al.
9,259,915 B2 2/2016 Dooley et al.
9,273,218 B2 3/2016 Liu
9,284,469 B2 3/2016 Song et al.
9,303,135 B2 4/2016 Eliyahu et al.
9,303,185 B2 4/2016 Sambhy et al.
9,327,519 B1 5/2016 Larson et al.
9,353,290 B2 5/2016 Condello et al.
9,365,742 B2 6/2016 Gervasi et al.
9,421,758 B2 8/2016 Song et al.
9,458,341 B2 10/2016 Song et al.
9,611,404 B2 4/2017 Sisler et al.
10,948,357 B2 3/2021 Cox
11,199,456 B2 12/2021 DeKam et al.
2002/0064648 A1 5/2002 Schlueter, Jr. et al.
2003/0067528 A1 4/2003 Chowdry et al.
2003/0152132 A1 8/2003 Pipe et al.
2003/0233952 A1 12/2003 Pan et al.
2003/0233953 A1 12/2003 Pan et al.
2003/0234840 A1 12/2003 Pan et al.
2004/0158056 A1 8/2004 Hiemstra et al.
2004/0253436 A1 12/2004 Heeks et al.
2005/0018027 A1 1/2005 Pan et al.
2005/0287386 A1 12/2005 Sabol et al.
2006/0008599 A1 1/2006 Hiyama
2006/0105117 A1 5/2006 Kim et al.
2006/0105177 A1 5/2006 Gervasi et al.
2006/0147659 A1 7/2006 Foley
2006/0152566 A1 7/2006 Taniuchi et al.
2007/0179291 A1 8/2007 Thibodeau et al.
2007/0207186 A1 9/2007 Scanlon et al.
2007/0207269 A1 9/2007 Woodhall et al.
2007/0242722 A1 10/2007 Nakamura
2007/0266896 A1 11/2007 Suwa et al.
2008/0032072 A1 2/2008 Taniuchi et al.
2008/0055381 A1 3/2008 Doi et al.
2008/0175304 A1 7/2008 Adelsberg et al.
2008/0206571 A1 8/2008 Berckmans et al.
2009/0110942 A1 4/2009 Henderson-Rutgers et al.
2009/0152664 A1 6/2009 Klem et al.
2009/0195579 A1 8/2009 Tousi et al.
2009/0237479 A1 9/2009 Yamashita et al.
2011/0018925 A1 1/2011 Ohara
2011/0025752 A1 2/2011 Law et al.
2011/0028620 A1 2/2011 Faucher et al.
2011/0122195 A1 5/2011 Kovacs et al.
2011/0122210 A1 5/2011 Sambhy et al.
2011/0269849 A1 11/2011 Yao
2012/0039648 A1 2/2012 Sambhy et al.
2012/0042518 A1 2/2012 Law et al.
2012/0083530 A1 4/2012 Mai et al.
2012/0103212 A1* 5/2012 Stowe ..... B41N 3/08 101/147
2012/0121827 A1 5/2012 Baird et al.
2012/0135650 A1 5/2012 Servante et al.
2012/0140009 A1 6/2012 Kanasugi et al.
2012/0162312 A1 6/2012 Ahl et al.
2012/0251685 A1 10/2012 Wang-Nolan et al.
2012/0274914 A1 11/2012 Stowe et al.
2012/0283098 A1 11/2012 Zhang et al.
2012/0301818 A1 11/2012 Gilmartin et al.
2013/0244173 A1 9/2013 Qiu et al.
2013/0266803 A1 10/2013 Dooley et al.
2013/0272763 A1 10/2013 Moorlag et al.
2014/0060352 A1 3/2014 Gervasi et al.
2014/0060357 A1 3/2014 Hsieh
2014/0060359 A1 3/2014 Kanungo et al.
2014/0060360 A1 3/2014 Moorlag et al.
2014/0060361 A1 3/2014 Gervasi et al.
2014/0060363 A1 3/2014 Kelly et al.
2014/0060365 A1 3/2014 Gervasi et al.
2014/0154377 A1 6/2014 Wang-Nolan et al.
2014/0168330 A1 6/2014 Liu et al.
2014/0307800 A1 10/2014 Sole Rojals et al.
2015/0004861 A1 1/2015 Gervasi et al.
2015/0022602 A1 1/2015 Landa et al.
2015/0031806 A1 1/2015 Lim et al.
2015/0077501 A1 3/2015 Breton et al.
2015/0085036 A1 3/2015 Liu
2015/0085039 A1 3/2015 Liu
2015/0116414 A1 4/2015 Eliyahu et al.
2015/0119510 A1 4/2015 Eliyahu et al.
2015/0165758 A1 6/2015 Sambhy et al.
2015/0258778 A1 9/2015 Dooley et al.
2015/0267078 A1 9/2015 Dooley
2015/0275022 A1 10/2015 Chen et al.
2015/0291847 A1 10/2015 Condello et al.
2015/0315403 A1 11/2015 Song et al.
2015/0315409 A1 11/2015 Song et al.
2015/0343797 A1 12/2015 Song et al.
2016/0083606 A1 3/2016 Sisler et al.
2016/0083607 A1 3/2016 Sisler et al.
2016/0083609 A1 3/2016 Sisler et al.
2016/0083636 A1 3/2016 Yoshida et al.
2016/0089875 A1 3/2016 Song et al.

(56) References Cited

U.S. PATENT DOCUMENTS

| | | | |
|---|---|---|---|
| 2016/0176185 | A1 | 6/2016 | Kanungo et al. |
| 2016/0237296 | A1 | 8/2016 | Song et al. |
| 2016/0280949 | A1 | 9/2016 | Song et al. |
| 2016/0305271 | A1 | 10/2016 | Schmidt et al. |
| 2016/0326376 | A1 | 11/2016 | Song et al. |
| 2017/0015115 | A1 | 1/2017 | Chen et al. |
| 2017/0051155 | A1 | 2/2017 | Larson et al. |
| 2017/0081545 | A1 | 3/2017 | Sisler et al. |
| 2017/0130087 | A1 | 5/2017 | Sisler et al. |
| 2017/0145240 | A1 | 5/2017 | Sisler et al. |
| 2017/0341452 | A1* | 11/2017 | Kanungo ..... B41C 1/10 |
| 2018/0058953 | A1 | 3/2018 | Byvank et al. |
| 2019/0113398 | A1 | 4/2019 | Comas et al. |
| 2019/0308372 | A1 | 10/2019 | Fernandez Aymerich et al. |
| 2020/0346405 | A1 | 11/2020 | Norfolk et al. |
| 2020/0378838 | A1 | 12/2020 | Litteaur |
| 2021/0394448 | A1 | 12/2021 | Atwood et al. |
| 2021/0396591 | A1 | 12/2021 | Atwood et al. |
| 2021/0396593 | A1 | 12/2021 | Atwood et al. |
| 2022/0134669 | A1 | 5/2022 | Garcia Grau et al. |
| 2022/0195221 | A1 | 6/2022 | Allen et al. |
| 2022/0205845 | A1 | 6/2022 | Atwood et al. |
| 2022/0228030 | A1 | 7/2022 | Dinh et al. |

FOREIGN PATENT DOCUMENTS

| | | | |
|---|---|---|---|
| EP | 2228690 | A1 | 9/2010 |
| EP | 3336150 | A1 | 6/2018 |
| JP | 62112647 | A | 5/1987 |
| WO | 2005047385 | A1 | 5/2005 |
| WO | 2015105668 | A1 | 7/2015 |
| WO | 2018194482 | A1 | 10/2018 |
| WO | 2020212488 | A8 | 10/2020 |

OTHER PUBLICATIONS

Author Unknown, "Dot Tool," Quality Engineering Associates, Inc., May 9, 2016, pp. 1-3.
Author Unknown, "Products and Properties: Desmodur/Desmophen for Coatings, Commercial Products," Bayer MaterialScience AG brochure, Edition: Jul. 2005 E, 28 pages.
Author Unknown, "Byk-Silclean 3700" by BYK Chemie, http://www.specialchem4coatings.com/tds/byk-silclean-3700/byk-chemie/10414/index.aspx?q= Byk%20Silclean%203700, 2013, 1 page.
Author Unknown, "Desmodur N 3790 BA," Bayer MaterialScience, LLC., http://www.bayermaterialsciencenafta.com/products/index.cfm?mode=lit&pp_num=EB7C52DD-F4EC-BDA1-6BE0225FFF5C1FDO&pg_num=EB7C5520-9065-98A0-5A4CD71113D57191&pf=0&pf=1, 2007, 1 page.
Bercen Inc., "Berset 2185," Technical Data Sheet, Mar. 14, 2012, 2 pages.
"Dimer Acids," Kirk-Othmer Encyclopedia of Chemical Technology, 1993, vol. 8, 4th Ed., pp. 223-237.
Cabot, "Specialty Carbon Blacks for Ultraviolet Protection & Weatherability," Cabot Corporation, Jun. 28, 2015, 2 pages.
Derwent Abstract of JP 62112647 A, 1990.
Dow, Dow Surfactants, http://www.dow.com/surfactants/products/second.htm, retrieved Mar. 10, 2014, pp. 1-2.
Dow, Material Safety Data Sheet, "Tergitol(TM) TMN-6 (90% AQ)," The Dow Chemical Company, Feb. 12, 2003, pp. 1-15.
Dow, Product Safety Assessment, "Triton CF Series Surfactants," Dec. 16, 2012, 6 pages.
DuPont, "DuPont Elvanol 51-05 Polyvinyl Alcohol," Product Data Sheet, 2006, http://www2.dupont.com/Elvanol/en_US/assets/downloads/elvanol_51_05.pdf, 3 pages.
Extended European Search Report for European Patent Application No. 21177430.2, dated Oct. 25, 2021 9 pages.
Extended European Search Report for European Application No. 21214119.6, dated May 16, 2022, 6 pages.
Jikei et al., "Synthesis and Properties of Hyperbranched Aromatic Polyamide Copolymers from AB and AB2 Monomers by Direct Polycondensation," Macromolecules, 2000, 33:6228-6234.
Kahn, Bruce E.,"The M3D Aerosol Jet System, An Alternative to Inkjet Printing for Printed Electronics," Organic and Printed Electronics, Winter 2007 1(1):14-17.
Kousiatza et al., "Temperature Mapping of 3D Printed Polymer Plates: Experimental and Numerical Study," MDPI, Sensors, 2017, 17(456), 14 pages.
Law et al., "Self Cleaning Polymers and Surfaces," TechConnect World Conference & Expo, Jun. 13-16, 2011, abstract of presentation, 1 page.
Notice of Submission of Opinions, issued in Korean Application No. 10-2021-0075857 (including a Google machine-translation), Apr. 28, 2022 18 pages.
Philipp et al., "Three Methods for In Situ Cross-Linking of Polyvinyl Alcohol Films for Application as Ion-Conducting Membranes in Potassium Hydroxide Electrolyte," NASA, Apr. 1979, 18 pages.
Reddy et al., "Citric acid cross-linking of starch films," University of Nebraska—Lincoln, Faculty Publications—Textiles, Merchandising and Fashion Design, Paper 25, 2009, pp. 702-711.
Song, "Starch crosslinking for cellulose fiber modification and starch nanoparticle formation," https://smarttech.gatech.edu/handle/1853/39524?show=full, downloaded Jan. 22, 2015, 4 pages.
Tse, Ming-Kai, "PIAS-II TM—A High-performance Portable Tool for Print Quality Analysis Anytime, Anywhere," Quality Engineering Associates (QEA), Inc., Jun. 2007, pp. 1-4.
Wang et al., "Preparation of a Crosslinking Cassava Starch Adhesive and its Application in Coating Paper," BioResources, 2013, 8(3):3574-3589.
Wikimedia, "Tetracarboxylic acids," 2 pages, printed on Aug. 19, 2015, https://commons.wikimedia.org/wiki/CategoryTetracarboxylic_acids.
Wikipedia, "Dicarboxylic Acid," 7 pages, printed on Aug. 19, 2015.
Wikipedia, "Hydrocarbon," Downloaded Mar. 2, 2016, 8 pages.
Wikipedia, "Tricarboxylic Acid," 2 pages printed on Aug. 19, 2015.

* cited by examiner

MULTI-LAYER IMAGING BLANKET

TECHNICAL FIELD

The disclosure relates to marking and printing systems, and more specifically to an imaging blanket of such a system.

BACKGROUND

Offset lithography is a common method of printing today. In a typical lithographic process, an image transfer member or imaging plate, which may be a flat plate-like structure, the surface of a cylinder, or belt, etc., is configured to have "image regions" formed of hydrophobic and oleophilic material, and "non-image regions" formed of a hydrophilic material. The image regions are regions corresponding to the areas on the final print (i.e., the target substrate) that are occupied by a printing or marking material such as ink, whereas the non-image regions are the regions corresponding to the areas on the final print that are not occupied by said marking material. The hydrophilic regions accept and are readily wetted by a water-based fluid, commonly referred to as a fountain solution or dampening fluid (typically consisting of water and a small amount of alcohol as well as other additives and/or surfactants to, for example, reduce surface tension). The hydrophobic regions repel fountain solution and accept ink, whereas the fountain solution formed over the hydrophilic regions forms a fluid "release layer" for rejecting ink.

The hydrophilic regions of the imaging plate correspond to unprinted areas, or "non-image areas", of the final print. The ink may be transferred directly to a substrate, such as paper, or may be applied to an intermediate surface, such as an offset (or blanket) cylinder in an offset printing system. In the latter case, the offset cylinder is covered with a conformable coating or sleeve with a surface that can conform to the texture of the substrate, which may have surface peak-to-valley depth somewhat greater than the surface peak-to-valley depth of the blanket. Sufficient pressure is used to transfer the image from the blanket or offset cylinder to the substrate.

The above-described lithographic and offset printing techniques utilize plates which are permanently patterned with the image to be printed (or its negative), and are therefore useful only when printing a large number of copies of the same image (long print runs), such as magazines, newspapers, and the like. These methods do not permit printing a different pattern from one page to the next (referred to herein as variable printing) without removing and replacing the print cylinder and/or the imaging plate (i.e., the technique cannot accommodate true high speed variable printing wherein the image changes from impression to impression, for example, as in the case of digital printing systems).

Efforts have been made to create lithographic and offset printing systems for variable data. One example is disclosed in U. S. Patent Application Publication No. 2012/0103212 A1 (the '212 Publication) published May 3, 2012, in which an intense energy source such as a laser is used to patternwise evaporate a fountain solution. The '212 publication discloses a family of variable data lithography devices that use a structure to perform both the functions of a traditional imaging plate and of a traditional imaging blanket to retain a patterned fountain solution of dampening fluid for inking, and to delivering that ink pattern to a substrate.

Typically, such imaging blankets use a seamless engineered rubber substrate (known as a 'carcass') on which e.g., polymer topcoats that form the reimageable surface, are coated and then cured. However, many rubber substrates are based on NBR (nitrile butadiene rubber) in which sulfur is used as a crosslinker and/or may otherwise contain sulfur. Sulfur inhibits the ability of some polymer composition to coat and cure on seamless engineered rubber substrates including substrate, such as NBR carcasses.

Accordingly, there is a need for polymer topcoats that can form reimageable surfaces on seamless carcasses that include sulfur, such as NBR carcasses, and imaging blankets incorporating the same.

BRIEF SUMMARY

This summary is intended merely to introduce a simplified summary of some aspects of one or more implementations of the present disclosure. This summary is not an extensive overview, nor is it intended to identify key or critical elements of the present teachings, nor to delineate the scope of the disclosure. Rather, its purpose is merely to present one or more concepts in simplified form as a prelude to the detailed description below.

The foregoing and/or other aspects and utilities exemplified in the present disclosure may be achieved by providing a multilayer imaging blanket for a variable data lithography system, including a multilayer base including a sulfur-containing layer; and a cured topcoat layer including a polyurethane in contact with the sulfur-containing layer of the multilayer base.

The multilayer base may include a bottom layer defining a lower contacting surface; a compressible layer; and a top layer.

The multilayer base may further include a reinforcing fiber layer disposed between the top layer and the compressible layer.

The top layer may include a reinforcing fiber layer.

The multilayer base may be configured to be stable up to 4 hours at up to 160° C.

The top layer may not be sulfur-free.

The top layer may include more than 0.03 weight % sulfur, based on a total weight of the top layer.

The top layer may include a nitrile butadiene rubber (NBR).

The top layer may include a sulfur crosslinker.

The topcoat layer may be compatible with dampening fluids.

The isocyanate component may include one or more isocyanates based on one or more of hexamethylene diisocyanate (HDI), isophorone diisocyanate (IPDI), diphenyl methylene diisocyanate (H12MDI), toluene diisocyanate (TDI), methylene diphenyl diisocyanate (MDI), and mixtures and combinations thereof.

The isocyanate component may include one or more of a prepolymer form, a biurets form, a trimerized form configured to form polyisocyanurates, and a blocked isocyanate form.

The hydroxyl component may include one or more of polymeric alcohols, polymeric diols, polymeric polyols based on hydroxyl functional polydimethylsiloxane, polymeric polyols based on hydroxyl functional polydimethylsiloxane-polyacrylate copolymers, polymeric polyols based on hydroxyl functional perfluoropolyethers, and mixtures and combinations thereof.

The topcoat layer may include an IR absorbing filler, and the IR absorbing filler may include one or more of carbon black, metal oxides, carbon nanotubes, graphene, graphite, carbon fibers, and mixtures and combinations thereof.

The IR absorbing filler may have an average particle size of from about 2 nanometers (nm) to about 10 μm.

The IR absorbing filler may include carbon black.

The topcoat layer may further include at least one of silica; a dispersant; and a catalyst.

The catalyst may include one or more of dibutyl tin dilaurate, stannous octoate, tertiary amine catalysts, 1,4-diazabicyclo[2.2.2]octane, N-methylmorpholine, dimethylaminopropyl amine, and mixtures and combinations thereof.

The foregoing and/or other aspects and utilities exemplified in the present disclosure may also be achieved by providing a variable data lithography system, including a multilayer imaging blanket including a multilayer base having a sulfur-containing bottom layer defining a lower contacting surface, wherein the lower contacting surface is configured to mount on a cylinder core of the variable data lithography system; and a cured topcoat layer including a polyurethane disposed on the multilayer base opposite the lower contacting surface of the sulfur-containing bottom layer; a fountain solution subsystem configured for applying a fountain solution layer to the multilayer imaging blanket; a patterning subsystem configured for selectively removing portions of the fountain solution layer so as to produce a latent image in the fountain solution layer; an inker subsystem configured for applying ink over the multilayer imaging blanket, such that, said ink selectively occupies regions of the multilayer imaging blanket where the fountain solution layer was removed by the patterning subsystem to thereby produce an inked latent image; and an image transfer subsystem configured for transferring the inked latent image to a substrate.

The multilayer base may further include a top layer configured to support the topcoat layer, wherein the top layer includes a nitrile butadiene rubber (NBR).

Further areas of applicability will become apparent from the detailed description provided hereinafter. It should be understood that the detailed description and specific examples, while indicating the preferred implementation of the invention, are intended for purposes of illustration only and are not intended to limit the scope of the invention

BRIEF DESCRIPTION OF THE DRAWINGS

The accompanying drawings, which are incorporated in, and constitute a part of this specification, illustrate implementations of the present teachings and, together with the description, serve to explain the principles of the disclosure. In the figures.

Figure 1:
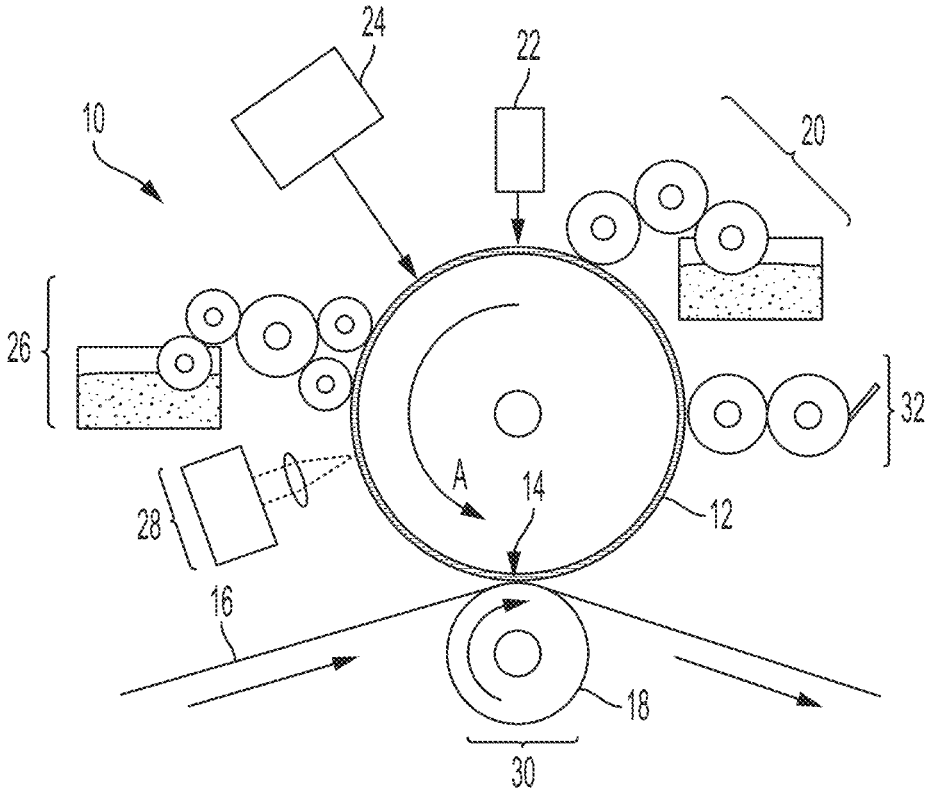
FIG. 1 illustrates a variable data lithography system according to an implementation.

It should be noted that some details of the figures have been simplified and are drawn to facilitate understanding of the present teachings rather than to maintain strict structural accuracy, detail, and scale.

DETAILED DESCRIPTION

Reference will now be made in detail to exemplary implementations of the present teachings, examples of which are illustrated in the accompanying drawings. Generally, the same reference numbers will be used throughout the drawings to refer to the same or like parts.

Throughout the specification and claims, the following terms take the meanings explicitly associated herein, unless the context clearly dictates otherwise. Phrases, such as, "in an implementation," "in certain implementations," and "in some implementations" as used herein do not necessarily refer to the same implementation(s), though they may. Furthermore, the phrases "in another implementation" and "in some other implementations" as used herein do not necessarily refer to a different implementation, although they may. As described below, various implementations can be readily combined, without departing from the scope or spirit of the present disclosure.

As used herein, the term "or" is an inclusive operator, and is equivalent to the term "and/or," unless the context clearly dictates otherwise. The term "based on" is not exclusive and allows for being based on additional factors not described unless the context clearly dictates otherwise. In the specification, the recitation of "at least one of A, B, and C," includes implementations containing A, B, or C, multiple examples of A, B, or C, or combinations of A/B, A/C, B/C, A/B/B/BB/C, AB/C, etc. In addition, throughout the specification, the meaning of "a," "an," and "the" include plural references. The meaning of "in" includes "in" and "on." Similarly, implementations of the present disclosure may suitably comprise, consist of, or consist essentially of, the elements A, B, C, etc.

It will also be understood that, although the terms first, second, etc. can be used herein to describe various elements, these elements should not be limited by these terms. These terms are only used to distinguish one element from another. For example, a first object, component, or step could be termed a second object, component, or step, and, similarly, a second object, component, or step could be termed a first object, component, or step, without departing from the scope of the invention. The first object, component, or step, and the second object, component, or step, are both, objects, component, or steps, respectively, but they are not to be considered the same object, component, or step. It will be further understood that the terms "includes," "including," "comprises" and/or "comprising," when used in this specification, specify the presence of stated features, steps, operations, elements, and/or components, but do not preclude the presence or addition of one or more other features, steps, operations, elements, components, and/or groups thereof. Further, as used herein, the term "if" can be construed to mean "when" or "upon" or "in response to determining" or "in response to detecting," depending on the context.

All physical properties that are defined hereinafter are measured at 20° to 25° Celsius unless otherwise specified.

When referring to any numerical range of values herein, such ranges are understood to include each and every number and/or fraction between the stated range minimum and maximum, as well as the endpoints. For example, a range of 0.5% to 6% would expressly include all intermediate values of, for example, 0.6%, 0.7%, and 0.9%, all the way up to and including 5.95%, 5.97%, and 5.99%, among many others. The same applies to each other numerical property and/or elemental range set forth herein, unless the context clearly dictates otherwise.

Additionally, all numerical values are "about" or "approximately" the indicated value, and take into account experimental error and variations that would be expected by a person having ordinary skill in the art. It should be appreciated that all numerical values and ranges disclosed herein are approximate values and ranges. The terms "about" or "substantial" and "substantially" or "approximately," with reference to amounts or measurement values, are meant that the recited characteristic, parameter, or values need not be achieved exactly. Rather, deviations or variations, including, for example, tolerances, measurement error, measurement accuracy limitations, and other factors known to those skilled in the art, may occur in amounts that do not preclude the effect that the characteristic was intended to provide.

Unless otherwise specified, all percentages and amounts expressed herein and elsewhere in the specification should be understood to refer to percentages by weight. The percentages and amounts given are based on the active weight of the material. For example, for an active ingredient provided as a solution, the amounts given are based on the amount of the active ingredient without the amount of solvent or may be determined by weight loss after evaporation of the solvent.

With regard to procedures, methods, techniques, and workflows that are in accordance with some implementations, some operations in the procedures, methods, techniques, and workflows disclosed herein can be combined and/or the order of some operations can be changed.

The terms "print media," "print substrate," and "print sheet" generally refer to a usually flexible physical sheet of paper, polymer, Mylar material, plastic, or other suitable physical print media substrate, sheets, webs, etc., for images, whether precut or web fed.

The term "printing device" or "printing system" as used herein refers to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A "printing system" can place marks on any surface, and the like, and is any machine that reads marks on input sheets; or any combination of such machines.

As used herein, the term "ink-based digital printing" is used interchangeably with "variable data lithography printing" and "digital offset printing," and refers to lithographic printing of variable image data for producing images on a substrate that are changeable with each subsequent rendering of an image on the substrate in an image forming process.

As used herein, "ink-based digital printing" includes offset printing of ink images using lithographic ink where the images are based on digital image data that may vary from image to image. As used herein, the ink-based digital printing may use a digital architecture for lithographic ink (DALI) or a variable data lithography printing system or a digital offset printing system, where the system is configured for lithographic printing using lithographic inks and based on digital image data, which may vary from one image to the next.

As used herein, "an ink-based digital printing system using DALI" may be referred to as a DALI printer.

As used herein, "an imaging member of a DALI printer" may be referred to interchangeably as a DALI printing plate and a DALI imaging blanket.

Many of the examples mentioned herein are directed to an imaging blanket (including, for example, a printing sleeve, belt, drum, and the like) that has a uniformly grained and textured blanket surface that is ink-patterned for printing. In a still further example of variable data lithographic printing, such as disclosed in the '212 Publication, a direct central impression printing drum having a low durometer polymer imaging blanket is employed, over which for example, a latent image may be formed and inked. Such a polymer imaging blanket requires, among other parameters, a unique specification of surface roughness, radiation absorptivity, and oleophobicity.

FIG. 1 illustrates a variable data lithography system according to an implementation. Additional details regarding individual components and/or subsystems shown in the variable data lithography system of FIG. 1 may be found in the '212 publication, which is herein incorporated by reference in its entirety. As illustrated in FIG. 1, a system 10 may include an imaging member 12 used to apply an inked image to a target image receiving media substrate 16 at a transfer nip 14. The transfer nip 14 is produced by an impression roller 18, as part of an image transfer mechanism 30, exerting pressure in the direction of the imaging member 12.

The imaging member 12 may include a reimageable surface layer (imaging blanket or carcass) formed over a structural mounting layer that may be, for example, a cylindrical core, or one or more structural layers over a cylindrical core. A fountain solution subsystem 20 may be provided generally comprising a series of rollers, which may be considered as dampening rollers or a dampening unit, for uniformly wetting the reimageable surface with a layer of dampening fluid or fountain solution, generally having a uniform thickness, to the reimageable surface of the imaging member 12. Once the dampening fluid or fountain solution is metered onto the reimageable surface, a thickness of the layer of dampening fluid or fountain solution may be measured using a sensor 22 that provides feedback to control the metering of the dampening fluid or fountain solution onto the reimageable surface.

The exemplary system 10 may be used for producing images on a wide variety of image receiving media substrates 16. The '212 Publication explains the wide latitude of marking (printing) materials that may be used, including marking materials with pigment densities greater than 10% by weight. Increasing densities of the pigment materials suspended in solution to produce different color inks is generally understood to result in increased image quality and vibrancy. These increased densities, however, often result in precluding the use of such inks in certain image forming applications that are conventionally used to facilitate variable data digital image forming, including, for example, jetted ink image forming applications.

As noted above, the imaging member 12 may include a reimageable surface layer or plate formed over a structural mounting layer that may be, for example, a cylindrical core, or one or more structural layers over a cylindrical core. A fountain solution subsystem 20 may be provided generally comprising a series of rollers, which may be considered as dampening rollers or a dampening unit, for uniformly wetting the reimageable plate surface with a layer of dampening fluid or fountain solution, generally having a uniform thickness, to the reimageable plate surface of the imaging member 12. Once the dampening fluid or fountain solution is metered onto the reimageable surface, a thickness of the layer of dampening fluid or fountain solution may be measured using a sensor 22 that provides feedback to control the metering of the dampening fluid or fountain solution onto the reimageable plate surface.

An optical patterning subsystem 24 may be used to selectively form a latent image in the uniform fountain solution layer by image-wise patterning the fountain solution layer using, for example, laser energy. It is advantageous to form the reimageable plate surface of the imaging member 12 from materials that should ideally absorb most of the IR or laser energy emitted from the optical patterning subsystem 24 close to the reimageable plate surface. Forming the plate surface of such materials may advantageously aid in substantially minimizing energy wasted in heating the fountain solution and coincidentally minimizing lateral spreading of heat in order to maintain a high spatial resolution capability. Briefly, the application of optical patterning energy from the optical patterning subsystem 24 results in selective evaporation of portions of the uniform layer of fountain solution in a manner that produces a latent image.

The patterned layer of fountain solution having a latent image over the reimageable plate surface of the imaging member 12 is then presented or introduced to an inker subsystem 26. The inker subsystem 26 is usable to apply a uniform layer of ink over the patterned layer of fountain solution and the reimageable plate surface of the imaging member 12. In implementations, the inker subsystem 26 may use an anilox roller to meter an ink onto one or more ink forming rollers that are in contact with the reimageable plate surface of the imaging member 12. In other implementations, the inker subsystem 26 may include other traditional elements such as a series of metering rollers to provide a precise feed rate of ink to the reimageable plate surface. The inker subsystem 26 may deposit the ink to the areas representing the imaged portions of the reimageable plate surface, while ink deposited on the non-imaged portions of the fountain solution layer will not adhere to those portions.

Cohesiveness and viscosity of the ink residing on the reimageable plate surface may be modified by a number of mechanisms, including through the use of some manner of rheology control subsystem 28. In implementations, the rheology control subsystem 28 may form a partial cross-linking core of the ink on the reimageable plate surface to, for example, increase ink cohesive strength relative to an adhesive strength of the ink to the reimageable plate surface. In implementations, certain curing mechanisms may be employed. These curing mechanisms may include, for example, optical or photo curing, heat curing, drying, or various forms of chemical curing. Cooling may be used to modify rheology of the transferred ink as well via multiple physical, mechanical or chemical cooling mechanisms.

Substrate marking occurs as the ink is transferred from the reimageable plate surface to a substrate of image receiving media 16 using the transfer subsystem 30. With the adhesion and/or cohesion of the ink having been modified by the rheology control system 28, modified adhesion and/or cohesion of the ink causes the ink to transfer substantially completely preferentially adhering to the substrate 16 as it separates from the reimageable plate surface of the imaging member 12 at the transfer nip 14. Careful control of the temperature and pressure conditions at the transfer nip 14, combined with reality adjustment of the ink, may allow transfer efficiencies for the ink from the reimageable plate surface of the imaging member 12 to the substrate 16 to exceed 95%. While it is possible that some fountain solution may also wet substrate 16, the volume of such transferred fountain solution will generally be minimal so as to rapidly evaporate or otherwise be absorbed by the substrate 16.

Finally, a cleaning system 32 is provided to remove residual products, including non-transferred residual ink and/or remaining fountain solution from the reimageable plate surface in a manner that is intended to prepare and condition the reimageable plate surface of the imaging member 12 to repeat the above cycle for image transfer in a variable digital data image forming operations in the exemplary system 10. An air knife may be employed to remove residual fountain solution. It is anticipated, however, that some amount of ink residue may remain. Removal of such remaining ink residue may be accomplished through use by some form of cleaning subsystem 32. The cleaning subsystem 32 may include at least a first cleaning member such as a sticky or tacky member in physical contact with the reimageable surface of the imaging member 12, where the sticky or tacky member removes residual ink and any remaining small amounts of surfactant compounds from the fountain solution of the reimageable surface of the imaging member 12. The sticky or tacky member may then be brought into contact with a smooth roller to which residual ink may be transferred from the sticky or tacky member, the ink being subsequently stripped from the smooth roller by, for example, a doctor blade.

Regardless of the cleaning mechanism, however, cleaning of the residual ink and fountain solution from the reimageable surface of the imaging member 12 is essential to prevent a residual image from being printed in the proposed system. Once cleaned, the reimageable surface of the imaging member 12 is again presented to the fountain solution subsystem 20 by which a fresh layer of fountain solution is supplied to the reimageable surface of the imaging member 12, and the process is repeated.

The imaging member 12 plays multiple roles in the variable data lithography printing process, which include: (a) deposition of the fountain solution, (b) creation of the latent image, (c) printing of the ink, and (d) transfer of the ink to the receiving substrate or media. Some desirable qualities for the imaging member 12, particularly its surface, include high tensile strength to increase the useful service lifetime of the imaging member. In some implementations, the surface of the imaging member 12 should also weakly adhere to the ink, yet be wettable with the ink, to promote both uniform inking of image areas and to promote subsequent transfer of the ink from the surface to the receiving substrate. Finally, some solvents have such a low molecular weight that they inevitably cause some swelling of imaging member surface layers. Wear can proceed indirectly under these swell conditions by causing the release of near infrared laser energy absorbing particles at the imaging member surface, which then act as abrasive particles. Accordingly, in some implementations, the imaging member surface layer has a low tendency to be penetrated by solvent.

Figure 2:
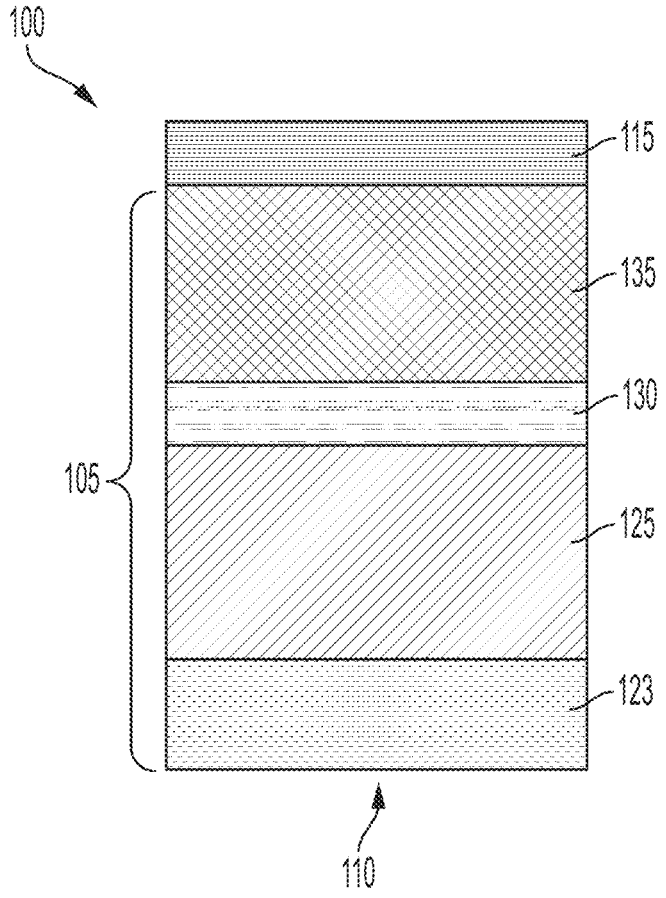
FIG. 2 illustrates a multilayer imaging blanket according to an implementation.

As described above, the imaging member 12 may include an imaging blanket. FIG. 2 illustrates a multilayer imaging blanket according to an implementation. As illustrated in FIG. 2, an imaging blanket may be implemented as a multilayer imaging blanket 100 including a multilayer base 105 and a topcoat layer 115. For example, a multilayer imaging blanket 100 for a variable data lithography system 10, may comprise a multilayer base 105 comprising a sulfur-containing layer, and a cured topcoat layer 115 comprising a polyurethane in contact with the sulfur-containing layer of the multilayer base 105.

The multilayer imaging blanket 100 may include a lower contacting surface 110, which is configured to contact directly or indirectly to e.g., a support, such as a cylinder core, to define an imaging blanket cylinder.

The multilayer base 105 may be a carcass designed to support the topcoat (e.g., surface) layer 115. In some implementations, the multilayer base 105 is stable at high temperatures such as from 140° C. to 180° C., such as 160° C., for an extended period of time, such as from between 2 and 6 hours, such as between 3 to 5 hours, such as about 4 hours. For example, the multilayer base 105 may be configured to be stable up to 4 hours at up to 160° C. The multilayer base 105 may include a bottom layer 123 defining a lower contacting surface 110, a compressible layer 125 and a top layer 135. In some implementations, a reinforcing fiber layer 130 is disposed between the top layer 135 and the compressible layer 125.

The bottom layer 123 may be a bottom fabric layer. The bottom fabric layer may be a woven fabric (e.g., cotton, cotton and polyester, polyester) with a lower contacting surface configured to contact directly or indirectly to a mandrel or other support such as a cylinder core to define a blanket cylinder. The bottom fabric layer may have a substance value in a range between 150-250 gr/m2.

In some implementations, the bottom layer 123 is a base sleeve, such as, a nickel metal cylinder. The base sleeve typically comprises an inner tubular cylindrical portion (not shown). The cylindrical portion (not shown) may have a through longitudinal bore enabling the sleeve to be mounted on, e.g., a rotary support, such as a cylinder core, and to present an inner surface arranged to cooperate with the outer surface of the rotary support.

The base sleeve, when intended for mounting on e.g., a rotary mandrel of fixed diameter, may be constructed of material sufficiently elastic to enable the portion itself to elastically expand radially by a minimum amount to enable it to be mounted on the rotary support. In this case, the base sleeve may be constructed of e.g., a thin nickel shell or can have a composite structure of resins and fiber glass with a radial thickness ranging from about, for example, 100 to 1000 micrometers (μall), such as 500 μm. Examples of compositions that are suitable for comprising the base sleeve include e.g., aramid fiber bonded with epoxy resin or polyester resin and reinforced polymeric material, such as hardened glass fiber bonded with epoxy resin or polyester resin, the latter two also known as fiberglass reinforced epoxy resin or fiberglass reinforced polyester. Typically, however, the base sleeve is composed of nickel.

The base sleeve may, in some implementations, be constructed of material sufficiently rigid, such that the inner tubular cylindrical portion (not shown) can retain a fixed diameter under pressure from an expanding rotary support. In some implementations, the base sleeve is desirably constructed of a composite structure of graphite impregnated plastics or of resins and fibers, such as carbon fibers. In the latter, the carbon fiber may be desirably oriented parallel to the rotational axis K in order to provide the sleeve with maximum rigidity. The sleeve can also be constructed of a rigid metal, e.g., steel or a rigid polyurethane, e.g., with a hardness exceeding 70° Shore D. In some implementations, the bottom layer 123 is a base sleeve with a radial thickness ranging from about, for example, 100 to 1000 micrometers (μm).

In some implementations, the bottom layer 123 is a base sleeve further comprising a fabric layer. The fabric layer may be attached to the base sleeve opposite the lower contacting surface of the base sleeve with an adhesive, e.g., a non-sulfur base adhesive such as an EPDM bonding adhesive.

The compressible layer 125 may be an elastomer having the properties needed to perform applications typically associated with offset printing. The elastomer typically ranges in thickness from 100-1000 μm. The compressible layer 125 may be formed using techniques known in the art. For example, an elastomeric compound including known processing, stabilizing, strengthening, and curing additives may be used to form the compressible layer 125. Any suitable polymeric material that is considered a curable or vulcanizable material can be used. An elastomer that is resistant to solvents and ink is desired. In some implementations, the compressible layer 125 may include microspheres impregnated into an elastomer as disclosed in U.S. Pat. No. 4,770,928, which is herein incorporated by reference in its entirety. In some implementations, the compressible layer 125 may be made of a polymeric foam, typically with EPDM rubber modified by adding an expansion agent. In other implementations, a polyurethane foam is used. In yet other implementations, the compressible layer 125 may include a nitrile butadiene rubber (NBR) and/or may contain sulfur.

The compressible layer 125 may be secured to the bottom layer 123 opposite the lower contacting layer 110 using techniques known in the art. For example, in construction, a compressible layer may be formed directly onto bottom layer 123 using pour or injection molding techniques. The compressible layer 125 may alternatively be applied using extrude spray spun processes or other techniques as is known in the art. Further, one skilled in the art will recognize that the compressible layer 125 may be substantially vulcanized prior to assembly or may be secured to the bottom layer 123 by means of a suitable adhesive.

The top layer 135 may include a rubber substrate. For example, the top layer 135 may be implemented as a seamless rubber substrate. In some implementations, the rubber substrate comprises a nitrile butadiene rubber (NBR). Typically, the thickness of the rubber substrate ranges from 100 to 1000 micrometers. Accordingly, a thickness of the top layer 135 may be from about 100 to about 1000 micrometers. For example, the thickness of the top layer 135 may be from about 100 to about 750 micrometers, from about 100 to about 500 micrometers, and 1000 micrometers or less.

As described in more detail below, the topcoat layer 115 may be compatible with sulfur. Accordingly, in some implementations, the top layer 135 is not sulfur-free. For example, the top layer 135 may comprise a sulfur crosslinker. The top layer 135 may include 0.03 weight % sulfur or more, based on the total weight of the top layer 135. For example, the top layer 135 may include 0.05 weight % sulfur or more, 0.10 weight % sulfur or more, 0.20 weight % sulfur or more, or 0.30 weight % sulfur or more, based on the total weight of the top layer 135.

The multilayer base 105 may further comprises a reinforcing fiber layer 130 disposed between the top layer 135 and the compressible layer 125. In some implementations, the top layer 135 further comprises a reinforcing fiber layer 130, typically comprising a layer of non-stretchable material. For example, the reinforcing fiber layer 130 may be a layer of woven or nonwoven fabric, a reinforcing film such as MYLAR® (polyester), a reinforced film such as carbon fiber or aramid fiber, cord, fiberglass or a surface layer of hard polyurethane. Where the reinforcing fiber layer 130 is formed from a fabric layer, the material may include plain woven fabric from high grade cotton yarns, which are free from slubs and knots, weaving defects, seeds, etc. The fabric may also be rayon, nylon, polyester, or mixtures thereof. The reinforcing fiber layer 130 may be secured to a rubber substrate to form the top layer 135 using any art known method including adhesion with a suitable adhesive, such as a bonding adhesive. The reinforcing fiber layer 130 of the top layer 135 may be secured to the compressible layer 125 opposite the bottom layer 123 using any art known method including suitable adhesives as described herein.

In some implementations, prior to the application of the topcoat layer 115 on the top layer 135 of the multilayer base 105, a primer layer (not shown) is applied to the top layer 135 to allow for interlayer adhesion between the multilayer base 105 and the topcoat layer 115. An example of the primer in the primer layer is a siloxane-based primer with the main component being octamethyl trisiloxane (e.g., S11 NC commercially available from Henkel). In addition, an inline corona treatment can be applied to the multilayer base 105 and/or primer layer to allow for and/or further improve adhesion, as readily understood by a skilled artisan. Such inline corona treatments may increase the surface energy and adhesion of the imaging blanket layers.

In other implementations, no primer layer and/or corona treatment are needed since the topcoat layer 115 adheres to the top layer 135 in the absence of a primer layer and/or in the absence of corona treatment.

The topcoat layer 115 may be implemented as a polyurethane topcoat layer 115. The topcoat layer may be applied to the top layer 135 as a coating composition and then cured, dried, and/or evaporated to form the topcoat layer 115.

The polyurethane topcoat layer 115 may include one or more of thermosetting and thermoplastic polyurethanes. As described in more detail below, the topcoat layer 115 may include an isocyanate component, a hydroxyl component, and an IR absorbing filler. In some implementations, the topcoat layer 115 may also include one or more of silica, a dispersant, and a catalyst.

As used herein, the terms "cure," "cured" and "curing" are interchangeable with the terms "crosslink," "crosslinked" and "crosslinking" respectively and encompass both thermosetting and thermoplastic polymers and are not limited to thermosetting polymers.

In one implementation, the topcoat layer 115 is compatible with dampening fluids, such as octamethylcyclotetrasiloxane (D4).

A thickness of the topcoat layer 115 may be from 10 to 500 micrometers. For example, the thickness of the topcoat layer 115 may be from about 10 to 400 micrometers, from about 10 to about 300 micrometers, from about 10 to 200 micrometers, from about 10 to 100 micrometers, or about 500 micrometers or less. In one implementation, the topcoat layer 115 has a thickness from about 60 to about 80 micrometers.

The isocyanate component may include one or more isocyanate components. For example, the isocyanate component may include one or more isocyanates based on one or more of hexamethylene diisocyanate (HDI), isophorone diisocyanate (IPDI), diphenyl methylene diisocyanate (H12MDI), toluene diisocyanate (TDI), methylene diphenyl diisocyanate (MDI), and mixtures and combinations thereof.

In other implementations, the isocyanate component may include one or more of a prepolymer form, a biurets form, a trimerized form configured to form polyisocyanurates, and a blocked isocyanate form. For example, the isocyanate component may include one or more of the Desmodur series available commercially from Covestro, Leverkusen, Germany.

The topcoat layer 115 may include from about 5 weight % to about 50 weight % isocyanate component, based on a total weight of the solids in the topcoat layer 115 (i.e. excluding solvents used in dilutions). For example, the topcoat layer 115 may include from about 5 weight % to about 40 weight % isocyanate component or from about 5 weight % to about 30 weight % isocyanate component, based on a total weight of the solids in the topcoat layer 115.

The hydroxyl component may include one or more hydroxyl components. For example, the hydroxyl component may include one or more of polymeric alcohols, polymeric diols, polymeric polyols based on hydroxyl functional polydimethylsiloxane, polymeric polyols based on hydroxyl functional polydimethylsiloxane-polyacrylate copolymers, polymeric polyols based on hydroxyl functional perfluoropolyethers, and mixtures and combinations thereof. Examples of useable hydroxyl components include Silclean 3700, 3701, 3710, and 3720, available commercially from BYK Altana, Wesel, Germany, and/or hydroxyl functional perfluoropolyethers such as Fluorolink E10H, E10, D, available commercially from Solvay S. A., Brussels, Belgium.

The topcoat layer 115 may include from about 30 weight % to about 90 weight % hydroxyl component, based on a total weight of the solids in the topcoat layer 115 (i.e. excluding solvents used in dilutions). For example, the topcoat layer 115 may include from about 30 weight % to about 80 weight % hydroxyl component or from about 30 weight % to about 60 weight % hydroxyl component, based on a total weight of the solids in the topcoat layer 115.

The IR absorbing filler may include one or more IR absorbing fillers. For example, the IR absorbing filler may include one or more of carbon black, metal oxides, such as iron oxide (FeO), carbon nanotubes, graphene, graphite, carbon fibers, and mixtures and combinations thereof.

The IR absorbing filler may have an average particle size of from about 2 nanometers (nm) to about 10 μm. The IR absorbing filler may have an average particle size of from about 20 nm to about 5 μm. In another implementation, the IR absorbing filler has an average particle size of about 100 nm. In one implementation, the IR absorbing filler includes carbon black, such as Monarch 1300 or Emperor 1600, available commercially from Cabot Corp., Boston, Mass.

The topcoat layer 115 may include from about 10 weight % to about 20 weight % IR absorbing filler, based on a total weight of the solids in the topcoat layer 115 (i.e. excluding solvents used in dilutions).

The topcoat layer 115 may further include silica. For example, in one implementation, the topcoat layer 115 may include from about 1 weight % to about 5 weight % silica based on a total weight of a composition used to form the topcoat layer 115. In another implementation, the topcoat layer 115 includes from about 1 weight % to about 4 weight % silica, based on the total weight of a composition used to form the topcoat layer 115. In yet another implementation, the topcoat layer 115 includes about 1.15 weight % silica based on the total weight of the composition used to form the topcoat layer 115. The silica may have an average particle size of from about 10 nanometers to about 0.2 μm. In one implementation, the silica may have an average particle size from about 50 nanometers to about 0.1 μm. In another implementation, the silica has an average particle size of about 20 nanometers.

An example of a useful silica includes Aerosil R812S available commercially from Evonik, Essen, Germany, and/or HDK2000 available commercially from Wacker, Munich, Germany.

The topcoat layer 115 may include about 6 weight % or less silica, based on a total weight of the solids in the topcoat layer 115 (i.e. excluding solvents used in dilutions).

The topcoat layer 115 may further include a dispersant. For example, a composition used to form the topcoat layer 115 may include one or more dispersants. In one implementation, the dispersant aids the dispersion of the IR absorbing filler, such as carbon black, within the composition used to form the topcoat layer 115. The dispersant may include PD2206 and PD 7000 available commercially from Croda, Snaith, UK.

The topcoat layer 115 may include about 2 weight % or less dispersants, based on a total weight of the solids in the topcoat layer 115 (i.e. excluding solvents used in dilutions).

The topcoat layer 115 may further include a catalyst. For example, a composition used to form the topcoat layer 115 may include one or more catalysts. In one implementation, the catalyst aids the reaction between the NCO and OH groups in the isocyanate component and the hydroxyl component within the composition used to form the topcoat layer 115. The catalyst may include one or more catalysts. For example, the catalyst may include dibutyl tin dilaurate, stannous octoate, tertiary amine catalysts, such as 1,4-diazabicyclo[2.2.2]octane, N-methylmorpholine, and dimethylaminopropyl amine. Examples of useful catalyst include the Addocat series available commercially from Rhein Chemie, Mannheim, Germany.

The topcoat layer 115 may include about 0.5 weight % or less catalysts, based on a total weight of the solids in the topcoat layer 115 (i.e. excluding solvents used in dilutions).

A coating composition may be used to create the topcoat layer 115. For example, a coating composition may include one or more solvents to dissolve components of the topcoat layer 115. The coating composition may then be applied to the top layer 135 and the solvent evaporated and/or the coating composition may be cured to create the topcoat layer 115 on the top layer 135. The one or more solvents may include one or more of trifluorotoluene, butyl acetate, ethyl acetate, MEK, MIBK, toluene, Novec 7200, Novec 7500, Novec 7600, and mixtures and combinations thereof.

The coating composition used to form the topcoat layer 115 may include from about 30 weight % to about 70 weight % solvent, based on a total weight of the composition.

As illustrated in FIG. 2, the topcoat layer 115 may be formed or coated on the top layer 135 of the multilayer base 105 opposite the lower contacting surface 110. Some implementations contemplate methods of manufacturing the imaging member topcoat layer 115. For example, in one implementation, the method includes depositing a topcoat layer 115 composition upon a multilayer base 105 comprising a rubber substrate, such as NBR, by flow coating, ribbon coating, ring coating, and/or dip coating; and curing the topcoat layer 115 composition at an elevated temperature to form the topcoat layer 115.

The curing may be performed at an elevated temperature of from about 100° C. to about 180° C. This elevated temperature is in contrast to room temperature. The curing may occur for a time period of from about 10 min to 2 hours. In some implementations, the curing time period is between 3 to 5 hours. In one implementation, the curing time period is about 45 minutes.

Accordingly, as illustrated in FIGS. 1-2, a variable data lithography system 10, may include a multilayer imaging blanket 100 comprising: a multilayer base 105 having a sulfur-containing bottom layer 123 defining a lower contacting surface 110, wherein the lower contacting surface 110 is configured to mount on a cylinder core of the variable data lithography system 10; and a cured topcoat layer 115 comprising a polyurethane disposed on the multilayer base 105 opposite the lower contacting surface 110 of the sulfur-containing bottom layer 123.

The variable data lithography system 10 may also include a fountain solution subsystem 20 configured for applying a fountain solution layer to the multilayer imaging blanket 100; a patterning subsystem 24 configured for selectively removing portions of the fountain solution layer so as to produce a latent image in the fountain solution layer; an inker subsystem 26 configured for applying ink over the multilayer imaging blanket 100, such that, said ink selectively occupies regions of the multilayer imaging blanket 100 where the fountain solution layer was removed by the patterning subsystem 24 to thereby produce an inked latent image; and an image transfer subsystem 30 configured for transferring the inked latent image to a substrate.

The multilayer base 105 may further include a top layer 135 configured to support the topcoat layer 115, and wherein the top layer 135 comprises a nitrile butadiene rubber (NBR).

Aspects of the present disclosure may be further understood by referring to the following examples. The examples are illustrative and are not intended to be limiting implementations thereof.

Example 1

In Example 1 a topcoat layer 115 was formed as follows: 10 grams of isocyanate (Desmotherm 2170 isocyanate from Covestro) and 20 grams of polyol (Silclean 3700 polyol from BYK) were dissolved in 30 grams of butyl acetate in a PPE bottle. 15 weight % of carbon black (Monarch 1300, available from Cabot) was then added to the bottle along with 100 g of 2.8 mm steel grinding balls. The contents were put on roll mill for 24 hours to break down and disperse the carbon black. The next day 0.005 weight % of dibutyl tin di laurate catalyst was added to the bottle and hand shaken for 5 min. The dispersion was then filtered and degassed. It was then coated on a rubber carcass containing a sulfur containing nitrile butadiene (NBR) (Rollins Courier NP) and on a sulfur-free NBR-composite carcass cured by electron beam (Trelleborg 3C). The coating was cured at 130° C. for 45 min. The topcoat composition cured completely on both carcasses clearly indicating that topcoat layer 115 can be formed on carcasses that contain sulfur according to implementations of the present invention as exemplified by Example 1.

Figure 3:
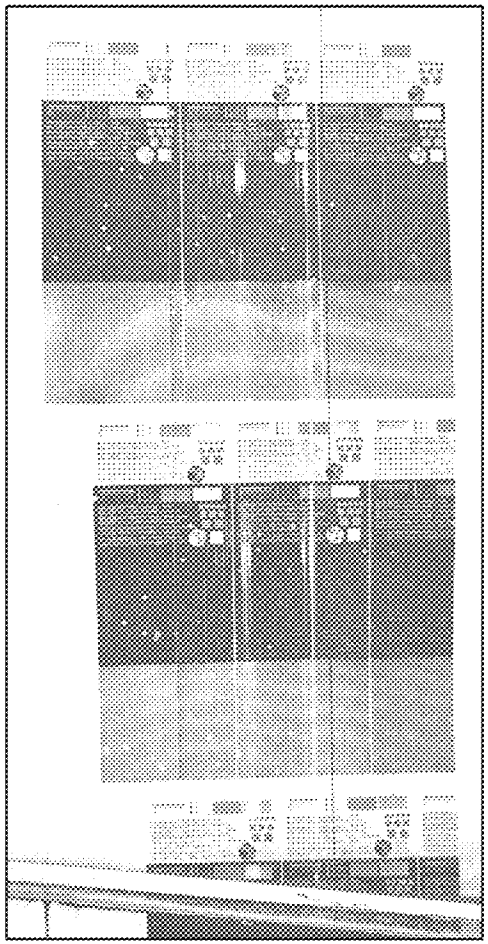
FIG. 3 illustrates printing results for a multilayer imaging blanket according to an implementation.

The topcoat layer formed on a Trelleborg 3C carcass using the topcoat composition of Example 1 was print tested on lab fixture running a Dali print process as described herein. FIG. 3 illustrates printing results for a multilayer imaging blanket according to an implementation. As illustrated in FIG. 3, initial print results based on Example 1 above show that the topcoat layer is capable of absorbing laser power and inking/transfer steps and can function as part of an imaging member in a DALI print process. In particular, FIG. 3 demonstrates that the topcoat composition of Example 1 performs adequately in all steps of a DALI printing process: The topcoat composition of Example 1 was successfully wetted by a fountain solution, kept ink from sticking to the topcoat composition of Example 1 in non-image areas when an imaging surface was brought in contact with the inker, and successfully absorbed laser power to evaporate fountain solution creating a latent image area with no fountain solution. The latent image areas having no fountain solution accepted ink when brought in contact with the inker, and the ink transferred to paper to create an image. As illustrated in FIG. 3, the image showed good optical density, halftones, fidelity, and sharpness.

Example 2

In Example 2 a topcoat layer 115 was formed as follows: 3 grams of isocyanate (Desmodur 3790 isocyanate from Covestro) and 15 grams of polyol (Fluorolink E10H polyol from Solvay) were dissolved in 25 grams of trifluorotoluene in a PPE bottle. 15 weight % of carbon black (Monarch 1300 available from Cabot) was then added to the bottle along with 100 g of 2.8 mm steel grinding balls. The contents were put on roll mill for 24 hours to break down and disperse the carbon black. The next day 0.005 weight % of dibutyl tin di laurate catalyst was added to the bottle and hand shaken for 5 min. The dispersion was then filtered and degassed. The topcoat layer composition was then coated on a sulfur-free Trelleborg 3C NBR-composite substrate and on a Rollins Courier NP NBR carcass containing sulfur. The topcoat layer composition was cured at 130° C. for 45 min. The topcoat layer composition cured completely on both carcasses clearly indicating that a topcoat layer 115 can be formed on carcasses that contain sulfur according to implementations of the present invention as exemplified by Example 2.

The topcoat layer 115 formed on a Trelleborg 3C carcass using the topcoat composition of Example 2 was print tested on lab fixture running a Dali print process as described herein.

Figure 4:
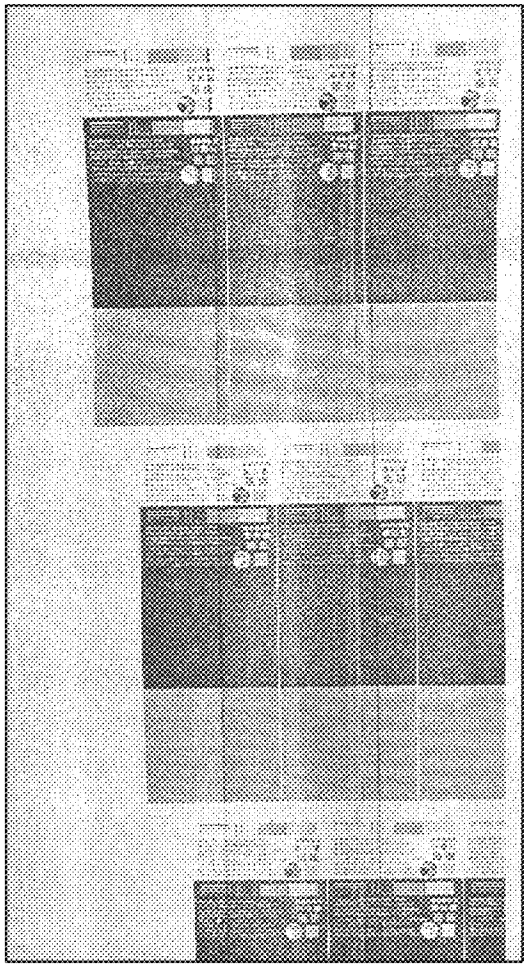
FIG. 4 illustrates printing results for a multilayer imaging blanket according to an implementation.

FIG. 4 illustrates printing results for a multilayer imaging blanket according to an implementation. As illustrated in FIG. 4, initial print results based on Example 2 above show that the topcoat layer is capable of absorbing laser power and inking/transfer steps and can function as part of an imaging member in a DALI print process. In particular, FIG. 4 demonstrates that the topcoat composition of Example 2 performs adequately in all steps of a DALI printing process: The topcoat composition of Example 2 was successfully wetted by a fountain solution, kept ink from sticking to the topcoat composition of Example 2 in non-image areas when an imaging surface was brought in contact with the inker, and successfully absorbed laser power to evaporate fountain solution creating a latent image area with no fountain solution. The latent image areas having no fountain solution accepted ink when brought in contact with the inker, and the ink transferred to paper to create an image. As illustrated in FIG. 4, the image showed good optical density, halftones, fidelity, and sharpness.

The present disclosure has been described with reference to exemplary implementations. Although a few implementations have been shown and described, it will be appreciated by those skilled in the art that changes may be made in these implementations without departing from the principles and spirit of preceding detailed description. It is intended that the present disclosure be construed as including all such modifications and alterations insofar as they come within the scope of the appended claims or the equivalents thereof.

What is claimed is:

1. A multilayer imaging blanket for a variable data lithography system, comprising:

a multilayer base comprising a sulfur-containing top layer; and a cured topcoat layer comprising a polyurethane in contact with the sulfur-containing top layer of the multilayer base, wherein the topcoat layer is compatible with sulfur, and wherein the top layer comprises 0.30 weight % sulfur or more, based on a total weight of the top layer.

2. The multilayer imaging blanket of claim 1, where the multilayer base comprises:

a bottom layer defining a lower contacting surface;

a compressible layer; and the top layer.

3. The multilayer imaging blanket of claim 2, wherein the multilayer base further comprises a reinforcing fiber layer disposed between the top layer and the compressible layer.

4. The multilayer imaging blanket of claim 2, wherein the top layer comprises a reinforcing fiber layer.

5. The multilayer imaging blanket of claim 2, wherein the top layer is not sulfur-free.

6. The multilayer imaging blanket of claim 2, wherein the top layer comprises a nitrile butadiene rubber (NBR).

7. The multilayer imaging blanket of claim 2, wherein the top layer comprises a sulfur crosslinker.

8. The multilayer imaging blanket of claim 1, wherein the multilayer base is configured to be stable up to 4 hours at up to 160° C.

9. The multilayer imaging blanket of claim 1, wherein the topcoat layer is compatible with dampening fluids.

10. The multilayer imaging blanket of claim 1, wherein the topcoat layer comprises an isocyanate component, and wherein the isocyanate component comprises one or more isocyanates based on one or more of hexamethylene diisocyanate (HDI), isophorone diisocyanate (IPDI), diphenyl methylene diisocyanate (H12MDI), toluene diisocyanate (TDI), methylene diphenyl diisocyanate (MDI), and mixtures and combinations thereof.

11. The multilayer imaging blanket of claim 1, wherein the topcoat layer comprises an isocyanate component, and wherein the isocyanate component comprises one or more of a prepolymer form, a biurets form, a trimerized form configured to form polyisocyanurates, and a blocked isocyanate form.

12. The multilayer imaging blanket of claim 1, wherein the topcoat layer comprises a hydroxyl component, and wherein the hydroxyl component comprises one or more of polymeric alcohols, polymeric diols, polymeric polyols based on hydroxyl functional polydimethylsiloxane, polymeric polyols based on hydroxyl functional polydimethylsiloxane-polyacrylate copolymers, polymeric polyols based on hydroxyl functional perfluoropolyethers, and mixtures and combinations thereof.

13. The multilayer imaging blanket of claim 1, wherein the topcoat layer comprises an IR absorbing filler, and wherein the IR absorbing filler comprises one or more of carbon black, metal oxides, carbon nanotubes, graphene, graphite, carbon fibers, and mixtures and combinations thereof.

14. The multilayer imaging blanket of claim 13, wherein the IR absorbing filler has an average particle size of from about 2 nanometers (nm) to about 10 μm.

15. The multilayer imaging blanket of claim 13, wherein the IR absorbing filler comprises carbon black.

16. The multilayer imaging blanket of claim 1, wherein the topcoat layer further comprises at least one of:

silica;

a dispersant; and a catalyst.

17. The multilayer imaging blanket of claim 16, wherein the catalyst comprises one or more of dibutyl tin dilaurate, stannous octoate, tertiary amine catalysts, 1,4-diazabicyclo [2.2.2]octane, N-methylmorpholine, dimethylaminopropyl amine, and mixtures and combinations thereof.

18. A variable data lithography system, comprising:

a multilayer imaging blanket comprising:

a multilayer base having a sulfur-containing bottom layer defining a lower contacting surface, wherein the lower contacting surface is configured to mount on a cylinder core of the variable data lithography system; and a cured topcoat layer comprising a polyurethane disposed on a top layer of the multilayer base and opposite the lower contacting surface of the sulfur-containing bottom layer;

a fountain solution subsystem configured for applying a fountain solution layer to the multilayer imaging blanket;

a patterning subsystem configured for selectively removing portions of the fountain solution layer so as to produce a latent image in the fountain solution layer;

an inker subsystem configured for applying ink over the multilayer imaging blanket, such that, said ink selectively occupies regions of the multilayer imaging blanket where the fountain solution layer was removed by the patterning subsystem to thereby produce an inked latent image; and an image transfer subsystem configured for transferring the inked latent image to a substrate, wherein the topcoat layer is compatible with sulfur, and wherein the top layer comprises 0.30 weight % sulfur or more, based on a total weight of the top layer.

19. The variable data lithography system of claim 18, wherein the top layer is configured to support the topcoat layer, and wherein the top layer comprises a nitrile butadiene rubber (NBR).

* * * * *